US005315806A

United States Patent [19]

Da Casta Trias de Bes

[11] Patent Number: 5,315,806

[45] Date of Patent: May 31, 1994

[54] STRUCTURE FOR CONCRETE FRAMEWORKS AND MEANS AND PROCEDURES FOR ITS MAKING

[76] Inventor: Alejandro Da Casta Trias de Bes, Aribau 326, 08006 Barcelona, Spain

[21] Appl. No.: 915,099

[22] Filed: Jul. 16, 1992

[51] Int. Cl.[5] ..... E04C 2/32; B28B 1/00

[52] U.S. Cl. ..... 52/81.1; 52/652.1; 52/654.1; 249/13; 249/64; 249/142; 249/182

[58] Field of Search ..... 52/81.1 R, 652.1, 654.1; 249/13, 64, 142, 189

[56] References Cited

U.S. PATENT DOCUMENTS

| | | | |
|---|---|---|---|
| 1,613,788 | 1/1927 | Dawson et al. | 52/652.1 |
| 3,258,891 | 7/1966 | Haberbosch | 52/654.1 |
| 3,305,997 | 2/1967 | Keay et al. | 52/652.1 |
| 3,313,074 | 4/1967 | Huntley | 52/654.1 |
| 4,211,044 | 7/1980 | Gugliotta et al. | 52/654.1 |
| 4,967,533 | 11/1990 | Weisse | 52/652.1 |

FOREIGN PATENT DOCUMENTS

| | | | |
|---|---|---|---|
| 3125744 | 5/1991 | Japan | 52/652.1 |
| 485079 | 3/1970 | Switzerland | 52/652.1 |
| 636348 | 12/1978 | U.S.S.R. | 52/652.1 |
| 964083 | 10/1982 | U.S.S.R. | 52/652.1 |

*Primary Examiner*—Carl D. Friedman
*Assistant Examiner*—Wynn Wood
*Attorney, Agent, or Firm*—Steinberg, Raskin & Davidson

[57] ABSTRACT

The said structure presents a constitution which, as well as providing a great resistance, supposes an effective reduction of the depth of floor slabs and technical layers built with current construction systems while allowing the incorporation of various technical elements and installations. For this reason the structure comprises two horizontal frameworks forming respective grillages (1, 2) which are linked to each other by means of pyramidal caps (3), whose bases are joined to the frames formed by the lower grillage (2) while its uppermost verices are linked to the intersections (5) of the upper frame (1), for which reason the said intersections are located over the centers (6) of the openings of the lower grillage (2), allowing the making of the structure by means of two procedures, one in which pyramidal (10) and tetrahedral (12) molds are employed, another in which the same pyramidal (10) molds are used, but in combination with others of two types, some triangular (23) type and others (21) constituted by two intersected triangular prisms with coinciding quadrangular faces forming a whole (22).

10 Claims, 2 Drawing Sheets

STRUCTURE FOR CONCRETE FRAMEWORKS AND MEANS AND PROCEDURES FOR ITS MAKING

BACKGROUND OF THE INVENTION

The present invention refers to a structure for concrete frameworks and to some means and procedures for making the said structure.

This structure presents a constitution that provides it with considerable capacity to resist and transmit load conditions and the possibility of incorporating diverse elements and installations, such as, amongst others, electrical and air conditioning ones, typical of buildings for offices, hotels, hospitals, etc., with the special feature of being able to link the elements indicated or enabling the installations to reach any point of the said structure by means of the passages formed in its constructive depth.

Advantageously, the constitution of the structure indicated assumes a reduction of the effective depth of the sum of the technical and structural layers typical of the frameworks made with known systems, such as those that consist of beams and small vaults or those formed of recoverable caissons, making possible the reduction of depth indicated so that, for example, some buildings that would have six floors with frameworks made according to conventional systems, would have one additional floor making them with the present structure.

SUMMARY OF THE INVENTION

With regard to all that, the structure in question consists of two horizontal frames constituted by respective grillages that form a square that are linked to each other by means of pyramidal caps the uppermost vertices of which are truncated and are joined together to the bonds of the intersection of the top frame, whilst the bases of the said pyramidal caps are joined to the framework that forms the lower one, for which the centres of its openings remain situated under the indicated bonds of intersection of the top frame.

Some methods for making the structure described comprise basically two types of molds, one which consists of some pyramidal parts with a quadrangular base truncated at the top and, alternatively, in the periphery of the base in order to obtain a bigger section in the lengths that form the two frames and another type consisting of some tetrahedral parts with two arrises perpendicularly opposite to one another truncated lengthways.

The procedure to be followed to make the structure consists of laying out on the base of the framing, before the concrete is poured, a series of pyramidal type molds forming rows and lines and with the necessary separation between them for the constitution of the lower frame, and then inserting between each two opposite faces of the said molds various tetrahedral type molds with their truncated arrises arranged above and below, these molds being supported on the other ones by means of convenient separators, so that there remains a zone of separation through which the concrete can penetrate.

The pyramidal type molds and/or those tetrahedral type ones can contain in their juxtaposed faces individual projections for obtaining, if required, some apertures in the pyramidal caps for cables or pipes to pass from the interior to the exterior of the structure, thus substituting the said projections for the separators.

Once the molds referred to have been arranged in the described manner, spaces are formed between those of the tetrahedral type that have the form of the pyramidal type but in an inverted position and which are occupied by respective molds of this type with their faces making contact with those of the four tetrahedrals that are adjacent, thus avoiding that the concrete occupies those spaces.

The combination of molds remains thus arranged for the definitive pouring and vibration of the concrete, after the positioning of the appropriate erections, braces and buttresses in accordance with known methods, the sections of the structure being formed, which fashion the respective grillages of their two frames, above and below the truncated arrises of the tetrahedral type molds, whilst the pyramidal caps are formed in between the said tetrahedral type molds and the pyramidal type molds in a normal position, the depth of the walls of the pyramidal caps defining the thickness of the separators between the former and the latter.

Once the resistance necessary in the setting process has been obtained, it is possible to continue with the stripping procedure, extracting first the pyramidal type molds in an inverted position by the upper face of the structure, then proceeding afterwards to remove the tetrahedral type molds by means of moving them laterally towards the space left by the previous ones, in order to be then able to lift and remove them in a diagonal movement through the mentioned space.

The pyramidal type molds in normal position can be removed through the lower face of the structure after the stripping of the general base of it, as is the case in present systems of recoverable caisson.

The pyramidal caps between them form the interior passages of the structure through which the installation systems of the building will pass, connecting the appliances and other elements which may be required in the recesses of the said pyramidal caps.

The structure can also be made by means of another combination of molds in which those of pyramidal type in an inverted position are substituted by others formed by two crosswise triangular prisms, with respective coinciding quadrangular faces forming a single one, and which are the result of the union of the triangular faces of the cited pyramidal type inverted molds, of respective parts corresponding to the extremes of the three in which the tetrahedral type molds are divided by means of various cuts through the longitudinal edges of one of its truncated arrises which is perpendicular to it, the intermediate and triangular parts remaining forming a third mold type, this combination facilitating its stripping.

These and other characteristics will be more easily understood from the detailed description that follows and to facilitate it two illustrated pages of drawings are enclosed in which a practical construction case has been described, which is cited purely as an example that does not limit the scope of the present invention.

BRIEF DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
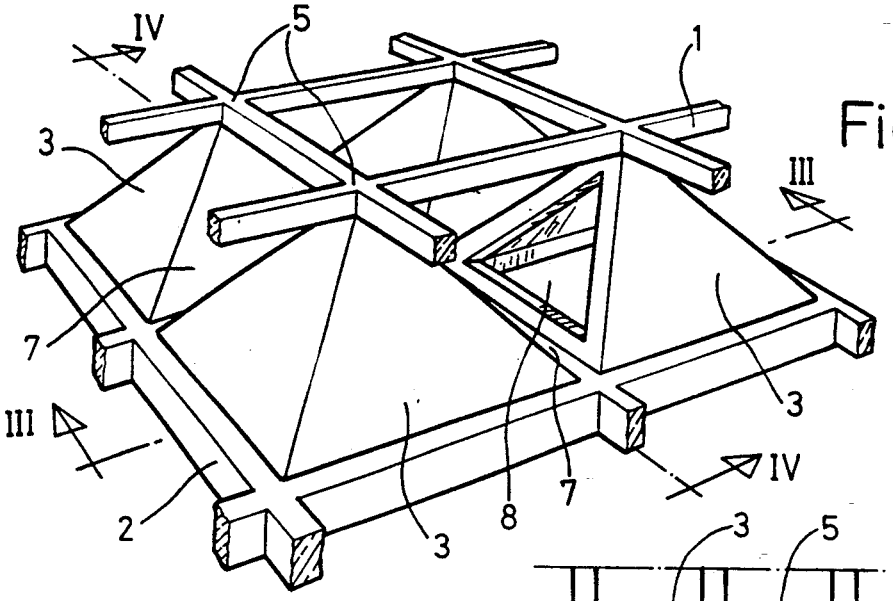
FIG. 1 is a perspective of a part of the structure in question.
Figure 2:
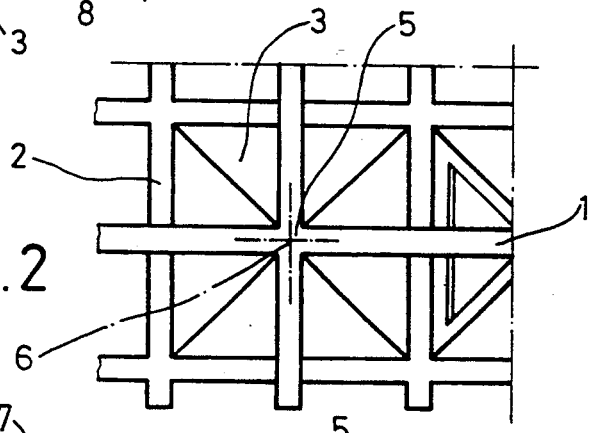
FIG. 2 illustrates a ground plan of the part of the structure of FIG. 1.
Figure 3:
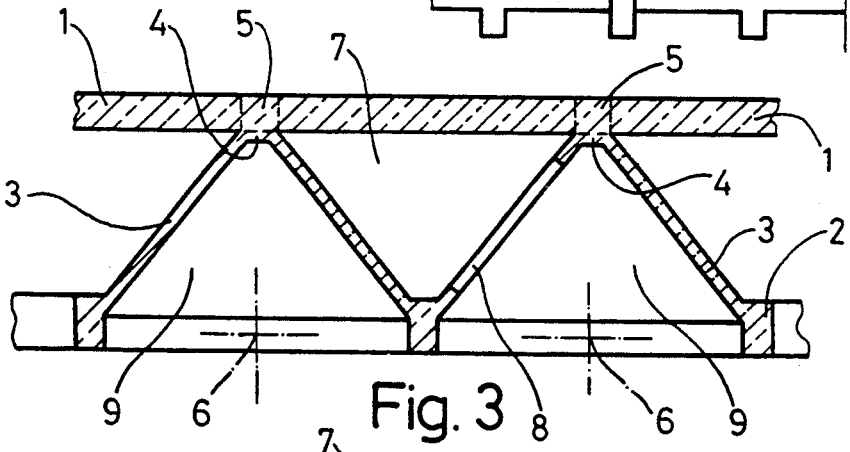
FIG. 3 shows in elevation a section of the part of the structure of FIG. 1 according to the line of cut III—III.
Figure 4:
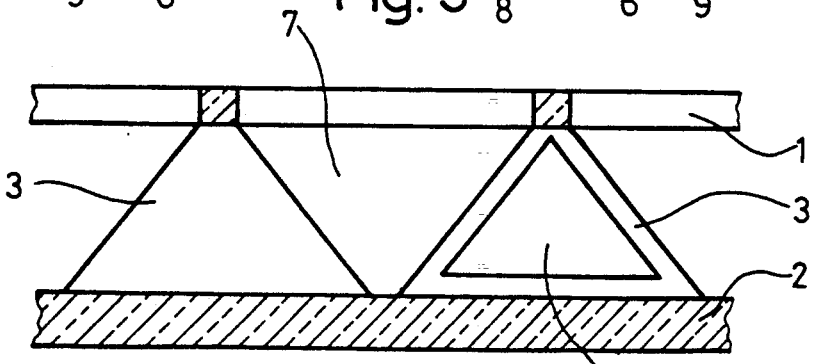
FIG. 4 is another section in elevation of the part of the structure of FIG. 1 according to the line of cut IV—IV.
Figure 5:
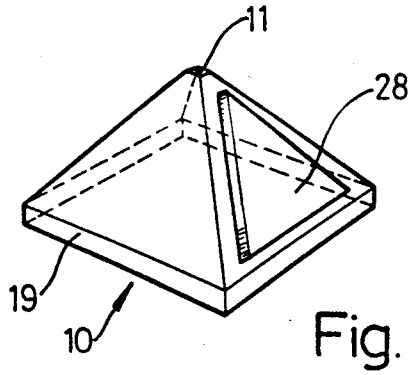
FIG. 5 shows a pyramidal mold in perspective.
Figure 6:
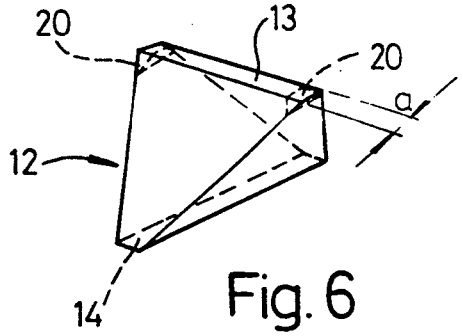
FIG. 6 also illustrates in perspective a tetrahedral mold.
Figure 7:
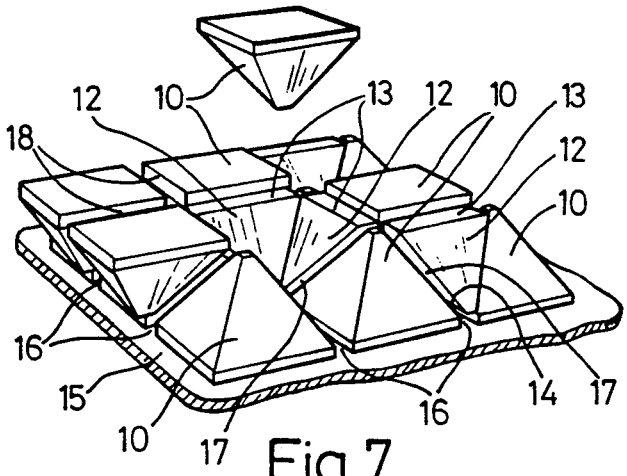
FIG. 7 shows in perspective various pyramidal and tetrahedral molds suitably arranged on a framing base to proceed with the making of the structure.

According to these diagrams, the structure for the concrete frameworks illustrated consists of two frames, an upper and a lower one, which form two horizontal grillages -1- and -2- making a square, which are linked together by pyramidal caps -3- of truncated upper vertices -4- and joined to the corresponding intersection bonds -5- of the grillage -1- whilst the base of the mentioned caps -3- are joined to the frames which form the grillage -2-, thus remaining the centres -6- of the gaps of this below the indicated intersection bonds -5- of the grillage -1-.

Between the cap walls -3- a series of passages -7- are formed which intersect with one another and which permit the easy incorporation of the installations that may be necessary, and their cables or pipes can be made to reach any pertinent point of the storey, having access to the exterior through some apertures -8- that one of the cap walls -3- presents situated in that point and of its concavity -9-, the apparatuses and appliances that may convenient being connected to the cables or pipes indicated.

If it is more convenient that the installations are situated in the floor of the building to be constructed, the structure can be arranged the other way around, in which case the concavities -9- of the caps -3- will communicate with the floor of the storeys.

The structure can be manufactured in various manners, one to be followed on the basis of the use of two types of molds, one being pyramidal -10- with a quadrangular base and with its top truncated -11-, and and the other tetrahedral -12- with two arrises -13- and -14- perpendicularly opposite one another, a series of the former being arranged over a base of the framing -15- forming rows and lines and with the respective bases presenting the same separation -16- between them.

Between each two facing walls of the molds -10- a tetrahedral mold -12- is introduced with its truncated arrises -13- and -14- situated above and below and which are supported over the molds -10- by means of appropriate separators (not illustrated) which will form some separations between both types of molds.

Finally, in the recesses that remain between the tetrahedral molds -12- various inverted pyramidal molds -10- will be coupled, the bases of which will project above forming some passages between them -18-, after which the mold becomes constituted in order for the corresponding concrete to be poured over it and, after the setting of the same and the following constitution of the structure, the operation of the stripping of the molds will be undertaken.

The grillages -1- and -2- of the structure are formed in the passages indicated, whilst the separations form the caps -3-, it being possible for the arrises of the base of the molds -10- and the ends of the upper truncated arris -13- of the molds -12- to present corresponding truncations -19- and -20- to reinforce, by means of obtaining a bigger section, the borders of the grillages -1- and -2- and the zones of union on the top of the caps -3-, it being possible for the said truncations -19- and -20- to present the shape that is considered necessary according to the type of form that it is desired to give to the parts of the structure indicated.

Another procedure for manufacturing the structure consists of arranging over the framing base -15- a first series of pyramidal molds -10- placed in the same manner as in the previous procedure, introducing a mold -21- between every fourth one of them, the shape of which forms the intersection of two triangular prisms with their respective quadrangular faces coinciding above to constitute one single one -22-.

Each one of these molds -21- is supported above the molds -10- by means of appropriate separators (not illustrated) with which the passages -17- are shaped that form the caps -3-, to which some third molds -23- of inverted triangular configuration also contribute, which are coupled each one of them, with the lower vertex truncated -24-, between respective triangular and vertical lateral faces -25- of the molds -21-, these molds -23- remaining arranged transversally between the opposite faces of the pyramidal molds -10- against which they lean by their edges across the pertinent separators.

Between the bases of the said molds -10- are shaped, in the same way as in the first procedure, the passages -16- in which the grillage -2- of the structure will be formed, the upper grillage -1- of which will be formed over the triangular molds -23- and the passages -18- that shape the upper parts of the molds -21- which include the quadrangular face -22-, as the said parts project from these molds -21-.

Figure 10:
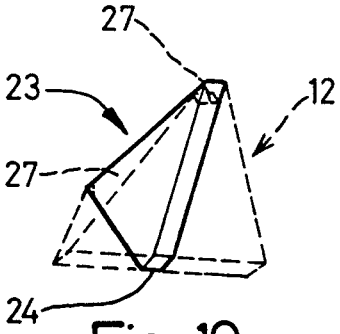
FIG. 10 also shows in lower perspective a triangular mold.
Figure 11:
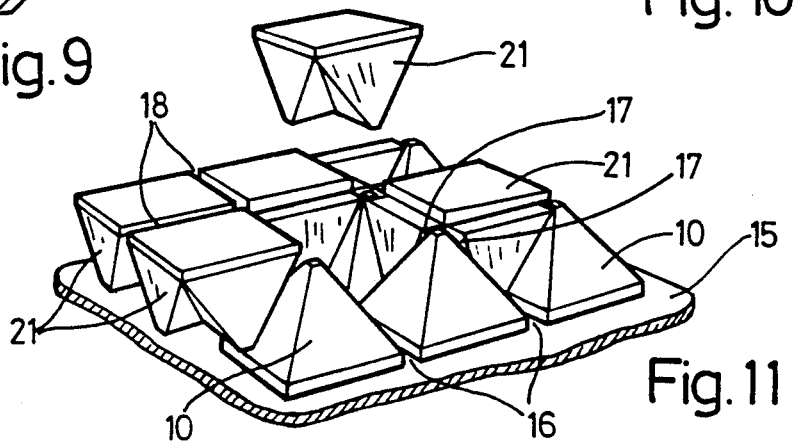
FIG. 11 is a perspective view of diverse triangular pyramidal molds, formed by the intersection of two triangular prisms arranged suitably on a framing base in order to make the structure.

Once coupled over the molds -10-, the molds -21- and -23- form the same combination as the molds -12- and the inverted ones -10- of the first procedure, the said mold -21- being in reality the result of joining the inverted mold -10- in one with the respective parts, in their four walls, of the extremes that would result from dividing in three the tetrahedral molds -12-, perpendicularly at the borders of one of its arrises -13- or -14-, the mold forming the intermediate piece (FIG. 10).

In a likewise manner as in the previous procedure, the arrises of the base of the molds -10- may present the truncation -19- in the form that is convenient, as may also the quadrangular face -22- of the mold -21- and the border of the upper side of the inverted triangular mold -23- present respective and convenient truncations -26- and -27-.

The second procedure, compared with the first one, presents the inconvenience that it consists of three types of molds instead of the two in the former, but with the advantage that the stripping of the same is more convenient and quicker, as the molds -21- are removed vertically from within the grillage -1- of the structure, it then being easy to remove the triangular molds -23- from the same.

Figure 8:
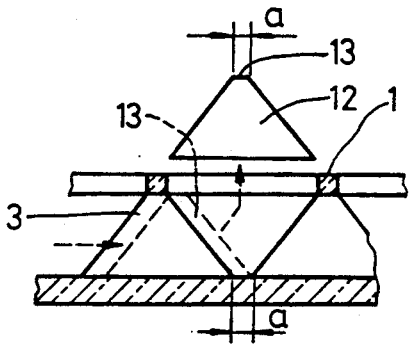
FIG. 8 illustrates in elevation the removal of a tetrahedral mold during the stripping phase.
Figure 9:
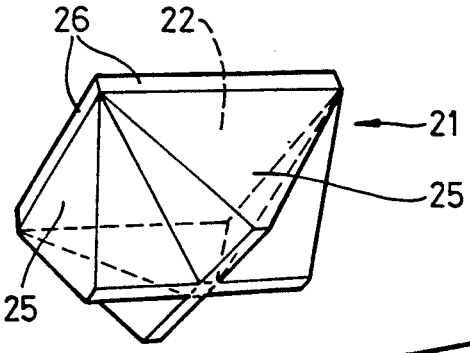
FIG. 9 shows in lower perspective a mold formed by two crosswise triangular prisms.

On the contrary, in the first procedure, there are only two types of molds used and being of simpler constitution, they are more economic to construct, but their stripping is more laborious and inconvenient as after the inverted molds -10- have been removed vertically, the -12- have to be displayed laterally toward the space left by the previous ones, in order then to raise them and remove them diagonally (FIG. 8), it being necessary to ensure always that the truncated arris -13- of the said tetrahedral molds -12- has to be of similar or less breadth -a- than the separation between the caps -3-, because otherwise they will remain blocked in the structure.

Finally, both in this procedure as in the other, in the points in which the caps -3- have to present an aperture -8-, the corresponding pyramidal molds -10- will present several projecting zones -28- on the appropriate walls, in order to form the aperture indicated, the corresponding molds being supported directly on the said zones, without separators being necessary, also with the possibility that these in some case are the ones presenting the projecting zones -28- indicated instead of the pyramidal molds -10- bearing them.

I claim:

1. A structure for concrete frameworks comprising:

upper and lower parallel horizontal frames, each constituted by an individual grillage, said upper frame having nodes of intersection and said lower frame defining spaces having centers, said nodes of intersection of said upper frame being situated above said centers of the spaces of said lower frame;

pyramidal caps having upper vertices and bases, each of said pyramidal caps comprising a substantially solid element having a single continuous strut or shell configuration including at least one solid wall, said upper vertices of said pyramidal caps being integrally connected to said nodes of intersection of said upper frame, said bases of said pyramidal caps being integrally bonded to said lower frame, thereby linking said upper frame to said lower frame to form a single integral framework structure.

2. The structure of claim 1, wherein said pyramidal caps each further comprises at least one cap wall having an aperture formed therethrough for allowing the passage of pipes of cables corresponding to the systems installed in the interior of the structure and to which will be connected the appropriate apparatuses and appliances.

3. A method for making a structure for concrete frameworks, said method comprising the steps of:

arranging a group of pyramidal type molds in lines and rows over a framing base;

providing separation between the pyramidal type molds for the formation of a lower frame of the structure;

situating tetrahedral type molds, each having two truncated arrises, between pairs of opposite faces of the pyramidal type molds;

supporting the tetrahedral type molds with appropriate separators for allowing the formation of pyramidal caps of the structure and for retaining a zone of separation through which concrete can penetrate;

inserting pyramidal type molds in an inverted position in the spaces that remain vacant;

allowing bases of the pyramidal type molds to protrude forming passages for allowing the formation of an upper frame of the structure; and pouring concrete over the molds.

4. A method for making a structure for concrete frameworks, said method comprising the step of:

arranging a group of pyramidal type molds in lines and rows over a framing base;

providing separation between the pyramidal type molds for the formation of a lower frame of the structure;

positioning various triangular type molds transversely between pairs of opposite faces of the pyramidal type molds, the triangular type molds being formed by two crosswise triangular prisms with coinciding individual quadrangular faces forming a single face and having truncated arrises situated downwards;

supporting the triangular type molds with separators for allowing the formation of pyramidal caps of the structure and for retaining a zone of separation through which concrete can penetrate;

inserting various molds of a third type, each having an inverted triangular configuration with at least one truncated vertex, in the spaces remaining;

allowing the quadrangular faces of the third triangular type molds to project from the other molds for allowing the formation of an upper frame of the structure; and pouring concrete over the molds.

5. The method of claim 3, further comprising the steps of:

providing individual projections on the faces of at least one of the pyramidal and tetrahedral type molds for obtaining apertures in the pyramidal caps for cables or pipes to be passed from the interior to the exterior of the structure.

6. The method of claim 3, further comprising the steps of:

allowing the concrete to set; and performing stripping procedures comprising the steps of: extracting the pyramidal type molds in an inverted position by an upper face of the structure; removing the tetrahedral type molds by moving them laterally towards a space defined by the inverted pyramidal type molds; and removing the pyramidal type molds in an upright position through a lower face of the structure.

7. Mold apparatus for making a concrete framework including an upper and the lower frame interconnected by pyramidal caps, said apparatus comprising:

a plurality of first mold members, each member being constituted by a pyramidal piece having a quadrangular base and a truncated top; and a plurality of second mold members, each member being constituted by a tetrahedral piece having two arrises perpendicularly opposite one another;

said first and second mold members situatable to define spaces between them in which said pyramidal caps are formed during a molding operation.

8. Mold apparatus for making a concrete framework including an upper and a lower frame interconnected by pyramidal caps, said apparatus comprising;

a plurality of first mold members, each member being constituted by a pyramidal piece having a quadrangular base and a truncated top;

a plurality of second mold members, each member being constituted by triangular pieces having at least one truncated vertex; and a plurality of third mold members, each member being constituted by pieces formed by two crosswise triangular prisms with coinciding individual quadrangular faces forming a single face, each of said third mold members having crosswise arrises opposite said face being truncated lengthwise;

said first, second, and third mold members situatable to define spaces between them in which said pyramidal caps are formed during a molding operation.

9. The mold apparatus of claim 7, wherein said quadrangular base of said pyramidal piece has arrises, said arrises of said quadrangular base of said pyramidal piece and two of said arrises of said tetrahedral piece being truncated to obtain a larger section of the lengths of said upper and lower frames and of a zone of union of said pyramidal caps to said upper frame.

10. The mold apparatus of claim 7, wherein at least one of said pyramidal and tetrahedral pieces comprises various projections of a configuration appropriate for forming apertures on cap walls of said pyramidal caps and against which corresponding faces of the juxtaposed pieces can be directly supported without separators being required.

* * * * *

UNITED STATES PATENT AND TRADEMARK OFFICE

CERTIFICATE OF CORRECTION

PATENT NO. : 5,315,806
DATED : May 31, 1994
INVENTOR(S) : Alejandro Da Costa Trias de Bes It is certified that error appears in the above-indentified patent and that said Letters Patent is hereby corrected as shown below:

Title page, item [19] "Casta" to --Costa--.

Title page, item [76] inventor: Alejandro Da", change "Casta" to--Costa--.

Signed and Sealed this

Nineteenth Day of November, 1996

*Attest:*

Bruce Lehman

BRUCE LEHMAN

*Attesting Officer*

*Commissioner of Patents and Trademarks*